US006012164A

United States Patent [19]

Deal, III

[11] Patent Number: 6,012,164

[45] Date of Patent: Jan. 11, 2000

[54] PROTECTIVE FACE MASK

[75] Inventor: James F. Deal, III, Fernandina Beach, Fla.

[73] Assignee: Apex Sports, LLC, Amelia Island, Fla.

[21] Appl. No.: 09/006,555

[22] Filed: Jan. 13, 1998

[51] Int. Cl.[7] ..... A41D 13/00

[52] U.S. Cl. ..... 2/9

[58] Field of Search ..... 2/410, 424, 425, 2/15, 10, 9

[56] References Cited

U.S. PATENT DOCUMENTS

| | | | |
|---|---|---|---|
| D. 237,843 | 12/1975 | Peterson et al. | D2/3 |
| D. 238,118 | 12/1975 | Rhee | D2/3 |
| D. 238,121 | 12/1975 | Rhee | D2/3 |
| D. 288,980 | 3/1987 | Pernicka | D29/17 |
| D. 317,063 | 5/1991 | Johnson | D29/17 |
| D. 384,441 | 9/1997 | Badger | D29/110 |
| 1,060,220 | 4/1913 | White | 2/9 |
| 1,449,183 | 3/1923 | Johnstone | 2/9 |
| 1,488,812 | 4/1924 | Goodman | 2/9 |
| 2,535,434 | 12/1950 | Marietta | 2/9 |
| 2,616,081 | 11/1952 | Weaver et al. | 2/9 |
| 2,627,602 | 2/1953 | Goldsmith | 2/9 |
| 3,041,623 | 7/1962 | Glahe | 2/9 |
| 3,220,014 | 11/1965 | Strohm et al. | 2/9 |
| 3,373,443 | 3/1968 | Marietta | 2/9 |
| 3,608,089 | 9/1971 | Abbatelli | 2/9 |
| 4,250,577 | 2/1981 | Smith | 2/427 |
| 5,206,955 | 5/1993 | Milligan | 2/9 |
| 5,267,353 | 12/1993 | Milligan | 2/9 |
| 5,335,371 | 8/1994 | Spessard | 2/9 |
| 5,737,770 | 4/1998 | Chen | 2/9 |

FOREIGN PATENT DOCUMENTS

| | | | |
|---|---|---|---|
| 619535 | 5/1961 | Canada | 2/9 |
| 621788 | 6/1961 | Canada | 2/9 |

OTHER PUBLICATIONS

Game Face™ Sports Mask User Instruction Manual, 5 pages, ©1996 by Spessard Group, Inc.

Game Face® Sports Safety Mask Safety Video (7:45 mins.).

*Primary Examiner*—Michael A. Neas

*Attorney, Agent, or Firm*—Synnestvedt & Lechner LLP

[57] ABSTRACT

A light weight protective face mask comprising an integrally molded shell of high impact plastic having a convex curvature for glancing deflection of impacting objects. Unobstructed vision is afforded by a generous vision aperture shaped like a pair of ski goggles. The mask has a projecting prow overlying and protecting the mouth of the wearer but allowing freedom of movement of the chin and jaw. An arched nose bridge overlies and protects the nose. Cushioning pads are attached to the inside surface of the mask overlying and engaging the face on the natural hard points of the bone structure of the skull. An elastic strap which has divergent bands cradling the back of the head holds the mask against the face of the wearer.

26 Claims, 4 Drawing Sheets

PROTECTIVE FACE MASK

FIELD OF INVENTION

This invention relates to masks worn for protection against facial injuries from impact, for example, from baseballs and the like during athletic games.

BACKGROUND OF INVENTION

Millions of children each year are exposed to the risk of serious facial injury while playing some form of baseball or softball, whether participating in organized leagues or non-league play. In 1995, for example, the Consumer Product Safety Commission issued Release #96-140 which reported 35,200 facial injuries due to ball impact which were serious enough to require emergency room treatment. Only 10% of these injuries occurred while the player was at bat. The player is at risk whether playing infield, outfield, pitching or at bat. Such injuries typically range from minor injuries, such as split lips and black eyes, to more serious injuries, such as broken teeth and fractures (noses, jaws or cheek bones) to very serious injuries, such as concussions, blinding or brain damage.

A batting helmet alone provides little protection for the face. Mask/batting helmet combinations provide excellent protection while the player is at bat, but these and other existing protective masks, such as catchers' masks and hockey goalie masks, are unsuited for use by a player in a fielding position.

To provide effective facial protection, a protective mask should be light weight and comfortable. Otherwise, children will not wear it. The mask should provide extensive coverage over all vulnerable areas of the face, including the forehead, temples, cheeks and upper jaw, lower jaw, chin, mouth, nose, eyes and neck. The mask should not, however, block or inhibit a player's vision, which is essential for batting or fielding. Adequate padding should be strategically positioned on the mask to help fit the mask to the player's face and absorb the energy of impact of a ball. The mask should also be designed to minimize the transfer of momentum from the ball to the player's face or head, thus, minimizing the trauma. It is also desirable that the mask be well ventilated and not interfere with a player's ability to speak or see.

The protective masks generally available fail to meet the criteria listed above and are, consequently, not in widespread use in youth baseball leagues or other sports, thus, permitting an unacceptably large number of facial injuries to occur to children every year due to baseball related mishaps.

SUMMARY AND OBJECTS OF INVENTION

The invention provides a light weight protective face mask to be worn by baseball players when batting, pitching or playing a field position. The mask comprises a strong, relatively rigid shell, preferably integrally molded from a high impact plastic such as ABS, polycarbonate, copolymers (copolymers made from acrylonitrile, butadiene and styrene) or polypropylene. The outer surface of the mask has a convex curvature designed to deflect a baseball from the face over a shallow, glancing angle, rather than at an acute angle. Shallow deflection angles prevent much of the momentum of the baseball from being transferred to the face and head on impact, thus, minimizing the force of impact and, hence, minimizing the injury to the player. Masks with angular or flat surfaces tend to trap the ball, resulting in a relatively large change in momentum causing greater impact force and more serious injury.

The inside surface of the mask has a concave curvature designed to accept and substantially cover the face from the upper forehead to the chin, wrapping around the face from temple to temple and providing coverage to the cheeks, upper jaw, lower jaw and mouth. It is preferable to provide a flap or plate extending from the lower portion of the shell and covering the throat and neck region beneath the chin.

The portions of the mask protecting the mouth and chin are curved to match the convex curvature of the mask's outer surface and are spaced apart from the mouth and chin, thus, allowing freedom of movement to the lower jaw. Accordingly, the player can talk, chew gum and the like comfortably. The portion overlying the mouth is connected to the shell by a plurality of elongated segments extending substantially radially from the mouth portion to portions of the shell overlying, and thereby protecting, the chin, cheeks and the lower and upper jaw of the player. This configuration allows for relatively large openings in the shell flanking the mouth, providing ventilation without sacrificing protection of vulnerable lips and teeth.

The nose of the player is preferably protected by a nose bridge, an arch-shaped structure extending from portions of the shell overlying the cheeks and upper jaw on either side of the mask. The nose bridge is arranged above the mouth portion, overlying but spaced away from the nose. This design permits additional ventilation openings within the mask between the nose bridge and the mouth protecting portion to facilitate breathing and cooling of the face without sacrificing protection of the nose. The arch configuration provides increased stiffness to the nose bridge, thus, limiting deflections of the structure on ball impact. The nose bridge is also convexly curved to match the curvature of the outer surface of the mask and, thus, does not provide a surface which would trap the ball and transfer the momentum at impact to the face of the wearer. Additional stiffening of the nose bridge is provided, preferably by including a raised rib integrally formed on the bridge outer surface. The stiffening rib decreases the deflection of the bridge under impact, thus, providing further protection against nose injuries.

A vision aperture is arranged above the nose bridge and extends substantially across the entire mask overlying the eyes of the player. The vision aperture is generous in size and shaped like a pair of ski goggles to provide a wide field of view without compromising facial protection. The ski goggle-shaped opening is narrower in the center of the mask between the eyes and comprises two large, bulbous lobes of essentially semi-circular shape symmetrically arranged on either side of the mask overlying the eyes. This design arranges the open space of the aperture to best advantage for an unobstructed view, essential for batting or fielding, while still providing adequate protection to the eyes.

Arranged above the vision aperture is the portion of the mask which protects the forehead. This mask portion is convexly curved matching the mask curvature and extends downward along the sides of the mask to overlie and protect the temples. A raised rib is preferably integrally formed on the outer surface of the forehead portion to stiffen this portion of the mask and thereby limit deflection under impact. This portion of the mask is designed to adequately protect the forehead without interfering with the brim of a baseball cap or batting helmet and, thus, the portion does not generally extend above the hairline.

The inside surface of the mask is concave to accept the face. Cushioning pads are provided to adapt the mask comfortably to the contours of the face and absorb the energy of impact before it can be transmitted to the face and head of the player. Preferably, urethane foam is used for the pads which are attached to the inside surface of the mask. The mask, according to the invention, uses three main cushioning pads to fit the mask to the face. One pad is positioned between the mask and the forehead, and the other two pads are arranged between the mask and the cheeks and upper jaws on either side of the mask. These three pads support the mask against the face and provide the main energy absorbing load path between the mask and the major structural bones of the face. Positioning the pads over the forehead and cheeks and upper jaw stabilizes the mask against natural hard points underlying the face, thus, helping keep the mask in place under strenuous play or impact. The hard points also provide a solid foundation against which the pads can react to absorb the energy of impact, thereby attenuating the energy transmitted to the face and head and reducing the severity of any injury. A fourth pad is added on the mask inside surface between the mask and the chin. This pad, however, does not provide a main support point or load path and, therefore, is not normally in contact with the chin or the jaw. The player is, thus, free to talk with the mask on. The fourth pad contacts the chin only when the mask is displaced by an impact to the mask forcing the mask against the chin.

The mask is held against the face by a tension strap which attaches to the shell adjacent to the vision aperture on either side of the mask. The shell is slotted to accept the strap which has elongated segments which interfit within the slots and extend rearward from the mask. The segments are attached to an upper and a lower band which diverge from the elongated segments at angles forming a diamond shape. When the mask is worn, the strap segments extend from the slots in the mask along the sides of the head, and the bands cradle the back of the head, the upper band passing over and engaging the crown, the lower band passing around and engaging the back of the head. The strap is adjustable in the conventional manner using buckles or Velcro® to adjust the strap length to accommodate different sized heads. There are also elastic elements in the strap to provide a preload biasing the mask securely yet comfortably against the face.

In an alternate tension strap embodiment, a pair of temple pieces are interposed between the mask and each elongated segment of the tension strap. A temple piece preferably comprises a relatively small flat plate having a polygonal shape. The strap segments each attach to a respective temple piece. Each temple piece, in turn, attaches to opposite sides of the mask by means of a respective flexible connector, for example, a short flexible loop. The loop is wider than the strap segments. The temple pieces are positioned close to the mask in overlying relationship with the temples of the wearer and are padded on the surface which faces the temple.

The temple pieces act as a transition piece between the relatively wide loop and the narrower strap segments. Using the temple pieces allows the mask to be more securely fastened to the face because the wide loops effectively prevent pivoting of the mask away from the face when the wearer bends over, and gravity tends to pull the mask downward away from the face. The narrower strap segments are more comfortable than a wide strap would be because they will not chafe the ears of the wearer. Thus, the temple pieces provide for both the superior attachment of the mask afforded by a wide strap with the superior comfort of a narrower strap.

It is an object of the invention to provide an improved protective face mask which is light weight and comfortable, yet provides adequate protection against facial injury from the impact of objects such as a baseball.

It is another object of the invention to provide an improved protective face mask which does not obstruct a player's vision, allowing the player to bat or field without hindrance.

It is yet another object of the invention to provide a protective face mask which deflects impacting objects through a shallow angle of deflection, thereby minimizing changes in momentum and reducing the forces transferred to the face and head of the player, thereby eliminating facial injury or at least mitigating its severity.

It is still another object of the invention to provide a protective face mask which allows the wearer to talk unimpeded.

DETAILED DESCRIPTION OF PREFERRED EMBODIMENTS

Figure 1:
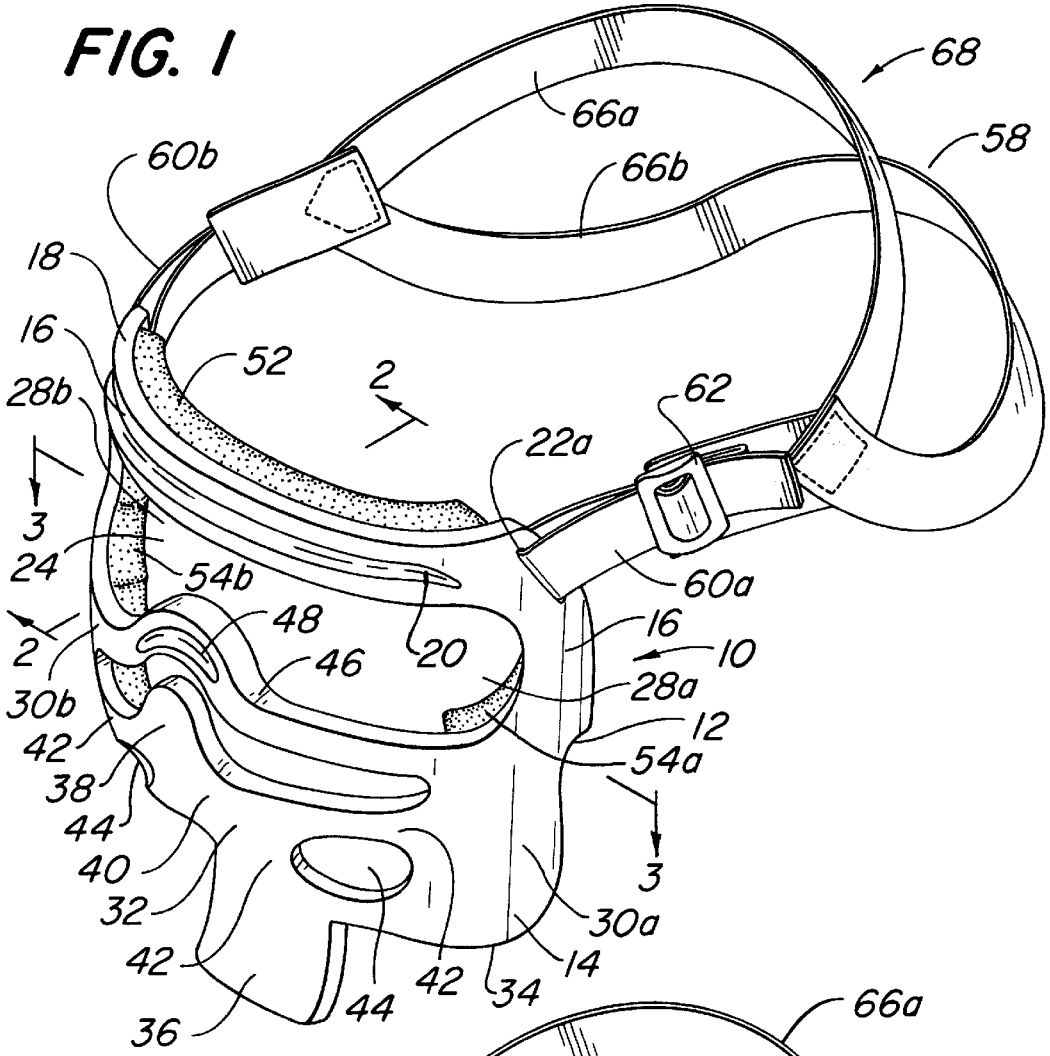
FIG. 1 shows an isometric view of a protective mask according to the invention.

FIG. 1 shows a protective mask 10 according to the invention. Mask 10 is formed from a relatively rigid shell 12, preferably integrally molded from a high impact plastic. Shell 12 has a convexly curved outer surface 14 designed to deflect a ball at a shallow glancing angle, minimizing the change in momentum when a ball strikes the mask and is deflected. Minimizing the change in momentum minimizes the force transferred to the face during an impact. Minimizing the force mitigates the severity of the injury to the player.

Shell 12 comprises a first shell portion 16 overlying and protecting the forehead and temples of the player. First portion 16 is convexly curved and has a raised stiffening rib 20 providing enhanced strength and stiffness to first portion 16. First portion 16 has strap attachment means in the form of slots 22*a* and 22*b* (shown in FIGS. 1 and 2) through shell 12 and arranged on either side of mask 10 adjacent to vision aperture 24. Slots 22*a* and 22*b* accept tension strap 58 (described in more detail below) which holds the mask to the player's face.

Figure 2:
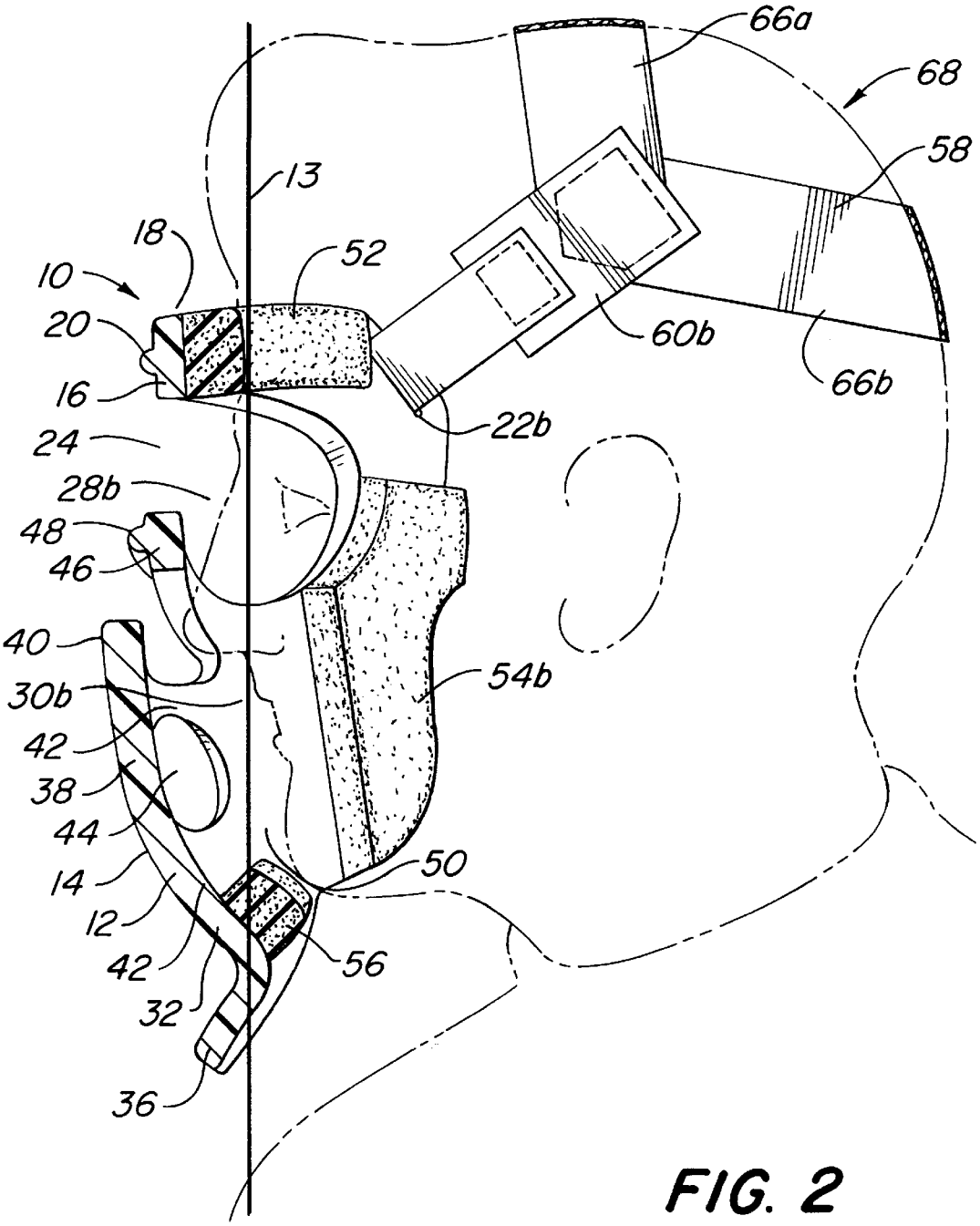
FIG. 2 shows a sectional view of the mask taken along line 2—2 on FIG. 1.

Vision aperture 24 overlies the eyes of the player, as seen in FIG. 2, and is shaped in the form of a pair of ski goggles. This design, being narrower in the center and having relatively large, bulbous lobes 28*a* and 28*b* arranged on either side of the mask provides a wide and unobstructed field of view to the player without compromising protection for the eyes and eye socket region of the face. Vision aperture 24 extends substantially across the entire mask 10 and is defined partly by first shell portion 16 and a pair of second shell portions 30*a* and 30*b* shown in FIGS. 1–3 and described below.

First shell portion 16 joins the pair of second shell portions 30*a* and 30*b* which extend downwardly therefrom. Shell portions 30*a* and 30*b* are arranged on either side of the mask overlying the cheeks and upper jaw of the player. The second shell portions 30*a* and 30*b* join a third shell portion 32 arranged at the bottom of mask 10 and overlying the lower jaw and chin of the player as best seen in FIG. 2. A plate or flap 36 extends downwardly from third shell portion 32 overlying the throat and neck area of the player and providing protection against impacts to these regions.

The mouth region of the player's face is protected by a fourth shell portion 38 which is in spaced apart relationship from and overlying the mouth, as illustrated in FIG. 2. Fourth shell portion 38 is convexly curved and is comprised of a projecting central region or prow 40 attached to the second and third shell portions 30*a*, 30*b* and 32 via elongated support member segments 42 which radiate outwardly from prow 40. Prow 40 and segments 42 define ventilation openings 44 adjacent to prow 40 which help make the mask more comfortable when worn in hot weather.

A nose bridge 46 is arranged between prow 40 and vision aperture 24 and comprises an arch-shaped member extending from second shell portions 30*a* and 30*b* to overlie the nose in a spaced apart relationship. Nose bridge 46 has a raised stiffening rib 48 on its outer surface which reinforces the arch-shaped member to reduce deflection of the nose bridge on impact, thus, providing increased protection to the nose of the player.

As best seen in FIG. 2, the relative positions of the various shell portions can be described with respect to an imaginary reference axis 13 which is vertically oriented and tangential to the wearer's forehead. In FIG. 2, each shell portion is seen to be at a different predetermined distance substantially perpendicularly from reference axis 13.

Figure 3:
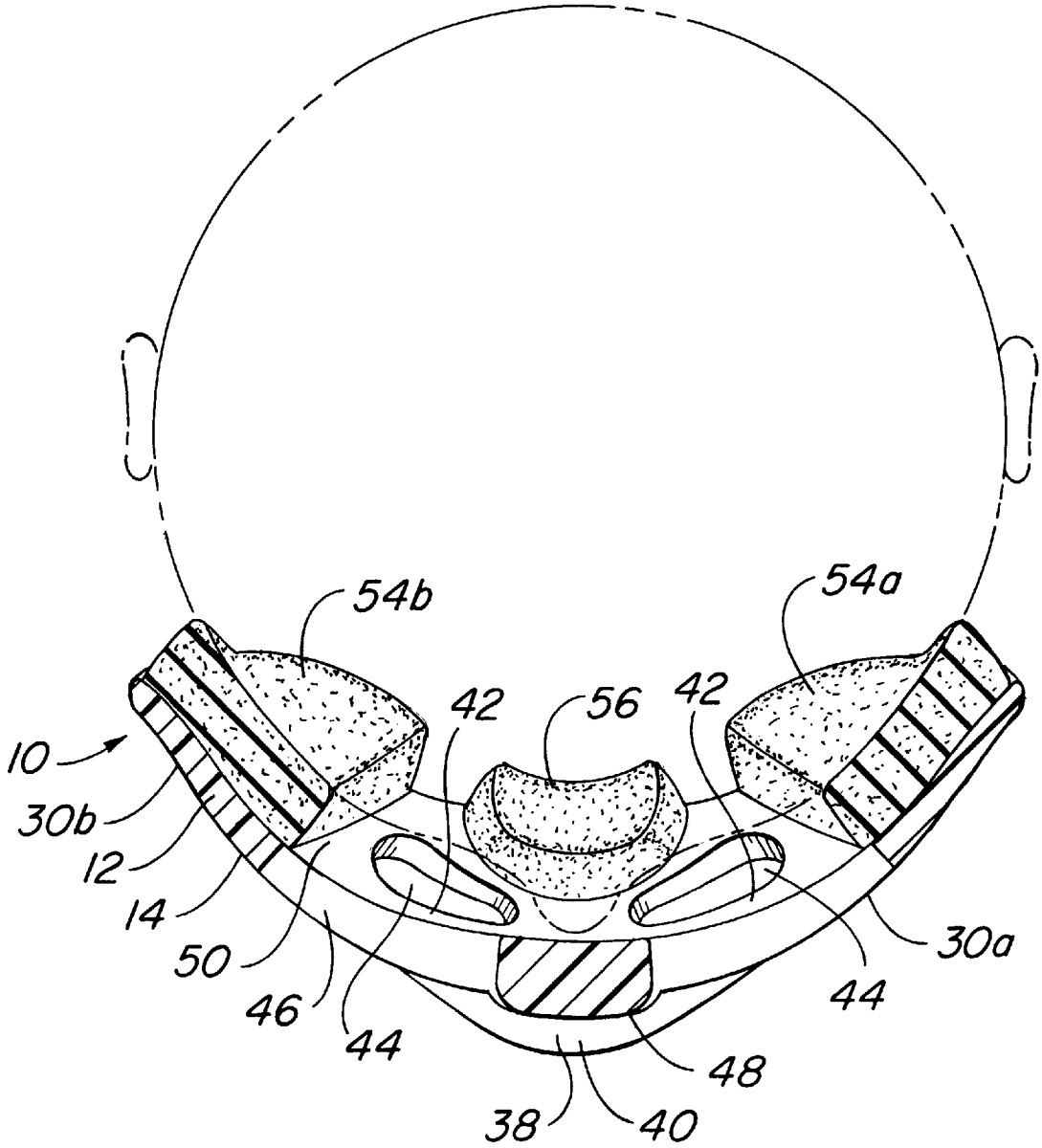
FIG. 3 shows a sectional view of the mask taken along line 3—3 on FIG. 1.

FIGS. 2 and 3 show the inside surface 50 of shell 12 which has a concave curvature to accept the face and wrap substantially around it. Attached to inside surface 50 are three cushioning pads 52, 54*a* and 54*b* which adapt the mask 10 to the face and support the mask firmly in place. The pads absorb impact energy and attenuate the force transmitted from the mask to the face and head when the mask is struck, as by a baseball. The pads are preferably made of urethane foam.

As seen in FIGS. 1 and 2, a first cushioning pad 52 is disposed beneath the first shell portion 16 between the shell inner surface 50 and the forehead of the player. First pad 52 engages the forehead and attenuates shocks to this region of the face when the mask is hit. A pair of second cushioning pads 54*a* and 54*b*, shown in FIGS. 1–3, are positioned on inner shell surface 50 on opposite sides of the mask 10 beneath second shell portions 30*a* and 30*b* and overlying the cheeks and upper jaw. These pads engage the cheeks and upper jaw region of the face, also attenuating shocks to the face and head caused by impacts to the mask. Pads 52, 54*a* and 54*b* are specifically positioned over natural hard points of the face, that is, points which overlie rigid bone structure of the skull. This pad positioning strategy gives the mask a stable three point mounting on which to rest and provides an effective foundation against which to react and attenuate impact forces.

A third pad 56 is positioned overlying the chin of the player and attached to the inside surface 50 beneath the third shell portion 32. As best illustrated in FIG. 2, third pad 56 does not normally engage the chin but is there to cushion the mask against the chin when the mask is deflected by a blow. By not normally engaging the chin, third pad 56 allows freedom of movement of the chin and lower jaw. This design allows the player to comfortably talk or chew gum without interference from the mask. Such design details are important if players are to be persuaded to adopt and wear the mask continuously and on a regular basis and their significance to the overall advantages of the mask should not be underestimated.

Figure 4:
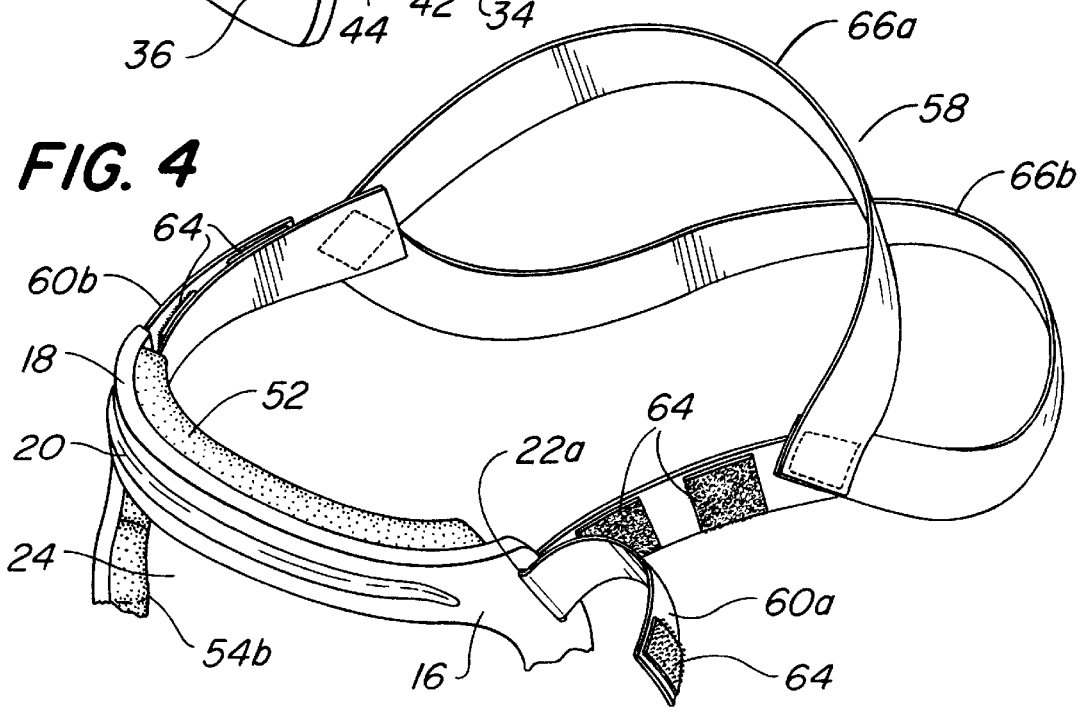
FIG. 4 shows a part of the mask detailing an alternate strap configuration.
Figure 5:
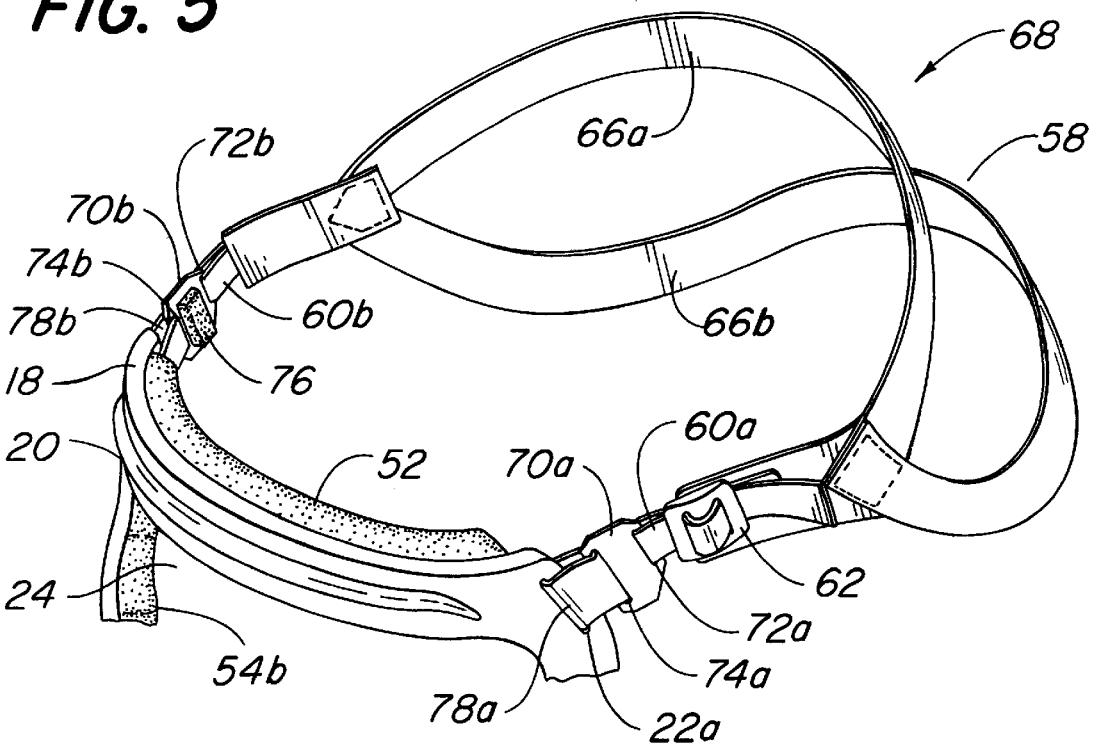
FIG. 5 shows a part of the mask detailing another alternate strap configuration.

Mask 10 is held securely in place by a strap 58, which may be of the form shown in FIGS. 1, 4 or 5. In one form, strap 58 comprises two end segments 60*a* and 60*b* which engage slots 22*a* and 22*b*, respectively, in first shell portion 16 adjacent to vision aperture 24. End segments 60*a* and 60*b* are adjustable by well known means, such as buckles 62 (seen in FIG. 1) or Velcro® pads 64 (see FIG. 4), which allow the length of strap 58 to be adjusted to the size of the player's head. End segments 60*a* and 60*b* extend from slots 22*a* and 22*b* and are attached to bands 66*a* and 66*b* which diverge at different angles from end segments 60*a* and 60*b* to form a diamond shape 68 when viewed in plan form. The diamond shape cradles the back of the player's head with upper band 66*a* engaging the crown of the head and lower band 66*b* engaging the back of the head. Preferably, strap 58 has some elasticity either in end segments 60*a* and 60*b* or in bands 66*a* and 66*b*. Elastic members allow the mask to be biased against the face, thus, ensuring that the mask remains in place during vigorous play or under the impact of a baseball. Adjustability of strap 58 provides both comfort and control of the degree of preload of the mask when biased against the face.

FIG. 5 shows another embodiment of the strap 58 configuration. In order to increase the comfort of the mask and simultaneously attach the mask more securely to the face of the wearer, temple pieces 70*a* and 70*b* are interposed between respective end segments 60*a* and 60*b* and slots 22*a* and 22*b* in the mask. Details of the construction and operation for the temple pieces are described below for one temple piece on one side of the mask, it being understood that both sides are identical in construction and operation.

Temple piece 70*a* preferably comprises a relatively small plate having a polygonal shape and strap attachment means in the form of slots 72*a* and 74*a* arranged in a parallel, spaced apart relationship at opposite ends of the temple piece. The slots are unequal in length and the shorter slot is offset from the center of the temple piece as described in more detail below. A pad 76 is attached to the surface of the temple piece facing the wearer. The temple piece rests in overlying relationship with the temple of the wearer and the pad cushions the wearer in the event of an impact to this region of the head.

Flexible attachment extension 78*a*, which preferably comprises a short loop of flexible material, engages slot 22*a* in the mask and slot 74*a* in the temple piece. Slot 74*a* is the relatively larger slot in temple piece 70*a* and accommodates a relatively wide attachment extension 78*a*. The width of the attachment extension, when the attachment extension is under tension as occurs when the mask is worn, helps prevent the mask from pivoting about a line through the slots 22*a* and 22*b* and away from the face. Such rotation would tend to occur for example when the wearer bends over to field a ground ball and the mask is pulled away from the face by gravity. If the attachment extension 78*a* were narrower, it would provide less resistance to such rotation of the mask. While it is desirable to have a wide attachment to prevent mask rotation as described above, having such a wide strap over the entire length of end segment 60*a* would be impractical because the wide strap would ride on and chafe the wearer's ear, causing discomfort. End segment 60*a* is therefore narrower in order to clear the ear as the end segment passes toward the back of the head. End segment 60*a* engages narrower slot 72*a* in temple piece 70*a*. Slot 72*a* is also offset upward from the center of temple piece 70*a* which helps to further separate end segment 60*a* from the ear.

Thus, use of the temple pieces 70*a* and 70*b* provides two advantages: (1) the mask is attached more securely to the face because undesired rotation of the mask is prevented; and (2) the temple pieces simultaneously allow a narrower strap to be used to ensure wearer comfort so that the ears are not chafed by a wide strap.

With its convex outer surface 14, large goggle-shaped vision aperture 24, extending prow 40, nose bridge 44, energy absorbing pads 52, 54*a*, 54*b* and 56 and head cradling elastic strap 58, the mask, according to the invention, provides an advantageous balance between the conflicting design requirements of protection, comfort and unobstructed vision necessary for a protective mask. By engaging the face's natural bone structure, the mask is kept securely in place during the most vigorous play and provides effective attenuation to blows and shock of impact, thereby eliminating or at least reducing the severity of facial injuries to the wearer.

Having described a few particular embodiments of the invention, various alterations, modifications and improvements will readily occur to those skilled in the art. Such alterations, modifications and improvements as are made obvious by this disclosure are intended to be part of this description, though not expressly stated herein, and are intended to be within the spirit and scope of the invention. Accordingly, the foregoing description is by way of example only and not limiting. The invention is limited only as defined in the following claims and equivalents thereto.

What is claimed is:

1. A mask for protecting a face of a wearer, the face comprising a forehead, a pair of temples, a nose, a pair of cheeks, a pair of eye sockets, an upper and a lower jaw, a mouth, a chin and a throat, said mask comprising:

a shell having a convexly curved outer surface and a concave inner surface to accept and substantially cover the face, said shell comprising a first shell portion for overlying the forehead and temples, two second shell portions disposed opposite one another for respectively overlying the cheeks and upper jaw, and a third shell portion for overlying the lower jaw and chin in spaced apart relationship to the lower jaw and chin such that the mask does not contact the face adjacent the third shell portion in the absence of an impact;

means mounted on said shell for overlying and protecting the nose in a spaced apart relationship to the nose;

forehead engaging means mounted on said inner surface and positioned on said first shell portion for providing cushioning support between said shell and the forehead;

cheek engaging means mounted on said inner surface and positioned on said second shell portions for providing cushioning support between said shell and the cheeks and upper jaw;

a vision aperture positioned in said shell between said first and second shell portions and extending substantially across said shell;

a fourth shell portion for overlying the mouth in spaced apart relationship, said fourth shell portion having a plurality of elongated segments extending therefrom to said second and third shell portions thereby attaching said fourth shell portion to said shell; and tension means for holding said forehead engaging means against the forehead and said cheek engaging means against the cheeks and upper jaw.

2. A mask according to claim 1, wherein said nose protecting means comprises a nose bridge extending from said second shell portions and disposed adjacent to said vision aperture for overlying the nose in a spaced apart relationship, at least a portion of said nose bridge extending beyond a vertical plane arranged tangentially to said first shell portion.

3. A mask according to claim 1, further comprising a flap rigidly attached to said third shell portion for overlying the throat in a spaced apart relationship, said flap being curved outwardly from said mask away from said throat.

4. A mask according to claim 1, wherein said shell is integrally molded in one piece from a plastic material.

5. A mask according to claim 4, wherein said plastic material is polycarbonate.

6. A mask according to claim 1, wherein said vision aperture comprises an opening in said shell having two bulbous lobes symmetrically disposed on either side of said mask for overlying the eye sockets, said lobes each extending from the center of the mask to respective points on opposite sides of the mask adjacent to the temples, said opening providing thereby an unobstructed field of vision to the wearer.

7. A mask according to claim 1, wherein said forehead engaging means comprises a forehead pad for overlying and contacting the forehead, said forehead pad having a first predetermined thickness and being made of a resilient material.

8. A mask according to claim 7, wherein said cheek engaging means comprises a pair of cheek pads, each cheek pad for overlying and contacting a respective cheek, each cheek pad having a second predetermined thickness and being made of a resilient material.

9. A mask according to claim 8, further comprising a chin engaging pad arranged on said inside of said shell and for overlying the chin, said chin engaging pad having a third predetermined thickness and being made of a resilient material, said chin engaging pad being further arranged normally spaced apart from the chin, said chin engaging pad for contacting the chin when said mask receives an impact.

10. A mask according to claim 9, wherein said pads comprise urethane foam.

11. A mask according to claim 9, wherein said first, second and third predetermined thicknesses are equal to one another.

12. A mask according to claim 1, wherein said tension means comprises:

first and second flexible attachment extensions each attached to said shell adjacent to said vision aperture and extending therefrom, one attachment extension being positioned on each side of said mask;

first and second temple pieces, each being attached to a respective attachment extension and extending therefrom for overlying the temples of the wearer;

a strap having first and second end segments, said first end segment being attached to one of said temple pieces, said second end segment being attached to another of said temple pieces, said strap for extending around the head of the wearer and securing said mask to said wearer.

13. A mask according to claim 12, wherein at least one of said temple pieces comprises a rigid plate having a cushioning pad attached thereto, said pad being interposed between said temple piece and the temple of the wearer.

14. A mask according to claim 12, wherein said flexible attachment extensions have a first predetermined width and said strap has a second predetermined width narrower than said first predetermined width for allowing said strap to extend around the head of said wearer without contacting the ears.

15. A mask according to claim 1, wherein said first shell portion overlies only a lower half of said forehead above said eye sockets to permit headgear to be worn by said wearer in conjunction with said mask.

16. A mask according to claim 1, wherein said nose protecting means extends outwardly from said face beyond a vertical plane arranged tangentially to said first shell portion thereby preventing simultaneous impact to both said nose protecting means and said first shell portion when said mask is struck straight on.

17. A mask according to claim 16, wherein said fourth shell portion and said segments extend outwardly from said face beyond a second vertical plane arranged tangentially to said nose protecting means.

18. A mask for protecting a face of a wearer, said mask comprising:

a shell having a curvature defining a convex outer surface and a concave inner surface, said shell wrapping substantially around the face and having a first shell portion for overlying the forehead and temples, a pair of second shell portions for overlying the cheeks and upper jaw, and a third shell portion for overlying the lower jaw and chin such that the mask does not contact the face adjacent the third shell portion in the absence of an impact, said first, second and third shell portions being rigidly interconnected;

a prow for overlying and protecting the mouth and lower jaw and being separated therefrom in a spaced apart relationship, said prow being disposed between said pair of second shell portions and having a plurality of support members extending therefrom connecting said prow rigidly to said pair of second shell portions and said third shell portion, said prow being outwardly curved to match the outward curvature of said shell;

an arch member extending from and rigidly attached to said second shell portions, said arch member being disposed adjacent to said prow, said arch member for overlying and protecting the nose and being separated therefrom in a spaced apart relationship, said arch member being outwardly curved to match the outward curvature of said shell;

a vision aperture disposed between said arch member and said first shell portion, said vision aperture extending substantially across said shell;

a first cushioning pad disposed on said inner surface beneath said first shell portion;

a pair of second cushioning pads disposed on said inner surface, one pad of said pair under each of said second shell portions; and an elongated strap having first and second ends connected to opposite sides of said shell.

19. A mask according to claim 18, further comprising a plate rigidly attached to said third shell portion and extending downwardly therefrom for overlying and protecting the throat, said plate being curved outwardly from said mask.

20. A mask according to claim 19, wherein said shell portions, said arch member, said prow and said plate are integrally molded from a plastic material.

21. A mask according to claim 20, wherein said plastic material comprises ABS copolymers.

22. A mask according to claim 18, further comprising a third cushioning pad disposed on said inside surface beneath said third shell portion, said third cushioning pad for overlying the chin in a spaced apart relationship.

23. A mask according to claim 18, having a pair of slots for receiving said first and second ends of said strap, one slot of said pair of slots being disposed on each side of said mask in said first shell portion.

24. A mask according to claim 18, further comprising an elongated reinforcing rib disposed on said outer surface of said shell on said first shell portion, said rib extending outwardly from and substantially across said first shell portion and thereby stiffening said mask.

25. A mask according to claim 18, further comprising a curved reinforcing rib disposed on and extending outwardly from said arch member.

26. A mask for protecting a face of a wearer, the face comprising a forehead, a pair of temples, a nose, a pair of cheeks, a pair of eye sockets, an upper and a lower jaw, a mouth, and a chin, an imaginary reference axis being defined tangential to the center of said forehead and extending vertically downwardly therefrom, said mask comprising:

a first shell portion for overlying the forehead, said first shell portion being spaced at a first predetermined distance substantially perpendicularly from the reference axis;

two second shell portions rigidly attached to said first shell portion and disposed opposite one another for respectively overlying the cheeks and upper jaw;

a third shell portion rigidly attached to said second shell portions for overlying the lower jaw and chin;

a bridge mounted on said shell for overlying and protecting the nose in a spaced apart relationship to the nose, said bridge being spaced at a second predetermined distance substantially perpendicularly from the reference axis, said second predetermined distance being greater than said first predetermined distance;

a vision aperture positioned between said first and second shell portions and extending substantially across said mask;

a fourth shell portion for overlying the mouth, said fourth shell portion being spaced at a third predetermined distance substantially perpendicularly from the reference axis, said third predetermined distance being greater than said second predetermined distance, said fourth shell portion having a plurality of segments extending therefrom to said second and third shell portions thereby attaching said fourth shell portion to said shell portions; and means for attaching said mask to the face of the wearer.

* * * * *